United States Patent [19]

Wilson

[11] Patent Number: 4,747,443

[45] Date of Patent: May 31, 1988

[54] CASTING PROCESS

[75] Inventor: Robert Wilson, Dundee, Scotland

[73] Assignee: University of Strathclyde, Glasgow, Scotland

[21] Appl. No.: 810,368

[22] PCT Filed: Apr. 11, 1985

[86] PCT No.: PCT/GB85/00157

§ 371 Date: Dec. 30, 1985

§ 102(e) Date: Dec. 30, 1985

[87] PCT Pub. No.: WO85/04705

PCT Pub. Date: Oct. 24, 1985

[30] Foreign Application Priority Data

Apr. 11, 1984 [GB] United Kingdom ..... 8409307

[51] Int. Cl.[4] ..... B22D 27/00

[52] U.S. Cl. ..... 164/58.1; 164/133; 222/590

[58] Field of Search ..... 164/58.1, 59.1, 57.1, 164/55.1, 133, 155, 335, 337; 222/590, 591, 606, 594, 600, 629; 260/166, 216

[56] References Cited

U.S. PATENT DOCUMENTS

| | | | |
|---|---|---|---|
| 3,819,365 | 6/1974 | McCaulay | 164/57.1 |
| 3,973,763 | 8/1976 | Steinke et al. . | |
| 4,010,876 | 3/1977 | Steinemann | 164/57.1 |
| 4,036,479 | 7/1977 | Chaze | 266/166 |

FOREIGN PATENT DOCUMENTS

| | | | |
|---|---|---|---|
| 7810741 | 11/1979 | France . | |
| 55-1928 | 1/1980 | Japan | 164/58.1 |

*Primary Examiner*—Nicholas P. Godici
*Assistant Examiner*—Gerard M. Reid
*Attorney, Agent, or Firm*—Pennie & Edmonds

[57] ABSTRACT

The invention relates to an improved casting furnace for the casting of metal or the like comprising a crucible (1) having a primary casting chamber (2) which is interconnected with one or more secondary casting chambers (3,4) to allow the melt to flow from the primary chamber to the secondary chamber or chambers. Means are provided in each secondary chamber (3,4) for introducing additives to the melt preferably close to the solidification point.

3 Claims, 1 Drawing Sheet

CASTING PROCESS

This invention relates to improvements in casting furnaces especially for continuously casting or static casting of most ferrous metals or alloys such as cast iron-and special steels, also the nonferrous metals such as copper, nickel, aluminium, tin, lead, zinc, gold and silver and alloys based thereon.

Such furnaces comprise a crucible, a die carrier into which interchangeable dies or moulds may be inserted and a feed channel for molten metal interconnecting the crucible and the die or mould when inserted into the die carrier.

An object of the invention is to enable additions of metals or other materials to be made to one or more chambers within the crucible away from the main metal holding compartment, each of the chambers being interconnected to provide continuity of metal flow.

According to the invention there is provided a casting furnace for metals or the like comprising a crucible having a primary melting chamber characterized in that there is provided one or more secondary chambers, passage means interconnecting said primary chamber and said secondary chamber or chambers whereby molten material can flow from the primary chamber to the secondary chamber or chambers, an outlet from said secondary chamber or chambers, and means associated with said secondary chamber or chambers for supplying additive material to a melt during a casting process.

According to a further aspect of the present invention there is provided a method of casting metal or the like comprising melting metal in a primary chamber, controllably feeding the molten metal from said primary chamber to one or more secondary chambers, and supplying additive material to the melt in said secondary chamber or chambers.

Figure 1:
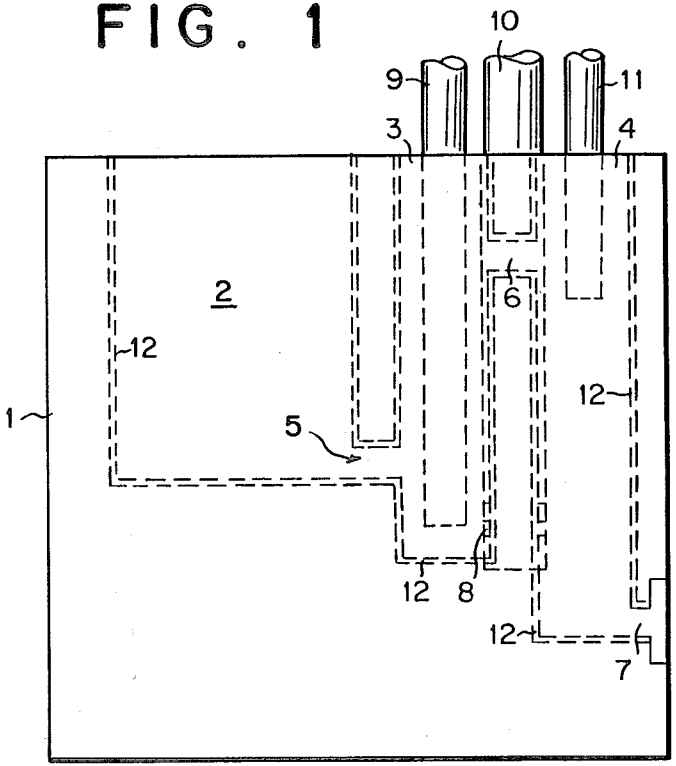
Figure 2:
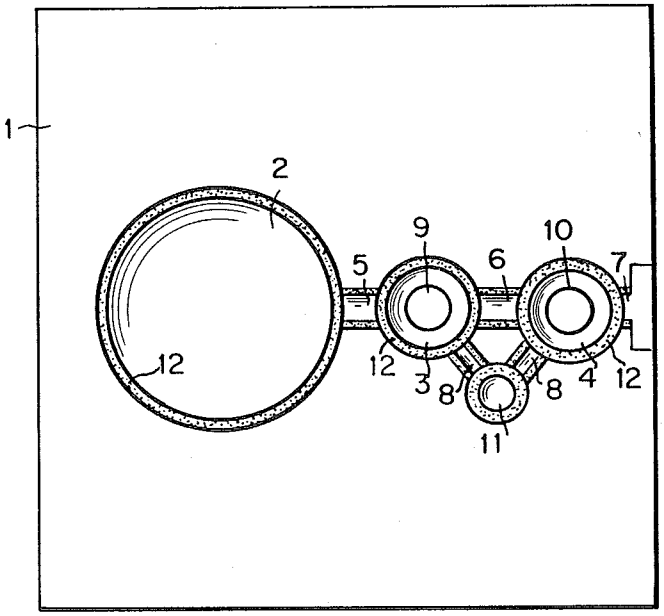

An embodiment of the invention will now be described by way of example in continuous casting of ductile cast iron, with reference to the accompanying schematic drawings, in which:

FIG. 1 is a front elevation of a continuous casting furnace in accordance with the present invention and FIG. 2 is a plan of the furnace shown in FIG. 1

Referring to the drawings, a continuous casting furnace comprises a housing or crucible 1 of refractory material, for example graphite, alumina or magnesia. Within the crucible 1 is formed a primary or main melt chamber 2 and a pair of secondary melt chambers 3, 4 which are spaced laterally from the primary melt chamber 2 and from each other.

A feed channel 5 interconnects the lower end of the primary melt chamber 2 with a location adjacent the lower end of the first secondary melt chamber 3. A feed channel 6 interconnects the secondary melt chambers 3 and 4 at an intermediate location towards the upper ends thereof as shown best in FIG. 1. An outlet 7 extends from the lower end of melt chamber 4 to a die or mould (not shown) so that cast material can be drawn off from the crucible 1.

In addition to the interconnecting feed channel 6, a drain channel 8 interconnects the lower ends of the secondary melt chambers 3 and 4. The drain channel 8, when open, allows the crucible to be drained of the melt contained therein. It will be noted that the bases of the primary melt chamber 2 and the secondary melt chambers 3 and 4 are disposed at progressively lower levels relative to each other in order to facilitate flow through the crucible 1.

The secondary melt chambers 3 and 4 are each provided with a tubular injector 9 and 10 respectively whereby controlled additions of metals or other additive materials can be made to respective secondary chambers during an operating cycle.

A vertically adjustable stopper 11 is provided to control or terminate the rate of flow of a melt through the drain channel 8 to the secondary melt chamber 4.

As can be seen from FIG. 2, the stopper 11, when viewed in a verticl direction, is offset relative to the plane through the axes of the secondary melt chambers 3, 4. The drain channel 8 is correspondingly angled as shown in FIG. 2 in order to interconnect each of the secondary melt chambers 3, 4 with the adjustable stopper 11. This angled arrangement of stopper 11 and secondary chambers 3, 4 allows them to be accommodated within less space than would otherwise be necessary.

The primary melt chamber 2 and the secondary melt chambers 3, 4 are each lined with replaceable refractory sleeves 12.

In operation of the casting furnace described above for the continuous casting of ductile cast iron, primary chamber 2 contains a grey iron melt. Continuously during the casting process, the grey iron melt flows from the primary chamber 2 by way of feed channel 5 into secondary melt chamber 3, where by means of injector 9 a trace element or elements such as magnesium is added to the melt. The melt then continuously flows through the feed channel 6 into the secondary melt chamber 4 where, by means of injector 10, a further addition of innoculant or conditioner is made as desired to the melt as it flows through chamber 4. The melt finally flows through outlet 7 to a die or mould.

The innoculant added in secondary chamber 4 can be any desired compound e.g. ferrosilicon and in this case the ferrosilicon must be added after magnesium in order to prevent carbon forming as free cementite (iron carbide).

The provision of secondary melt chambers in the manner described above permits the addition to a melt of additive materials having a limited reactive life in a manner in which the time of contact with the melt is minimised. A further advantage of the invention is that by having a primary melt chamber having one or more secondary melt chambers interconnected therewith, adjustments to the composition of the final metal can be made within the secondary chamber or chambers at a stage fairly close to the solidification point. Thus the arrangement has the advantage of precise composition adjustment, deoxidation of super pure metals or limitation of the time of contact of a corrosive metal or other material with the primary melting chamber and thus making it possible to cast a much wider range of alloys.

It will be appreciated that a casting furnace according to the invention can be provided with any suitable number of interconnected secondary melt chambers as desired e.g. one or more. Furthermore the invention is equally applicable to continuous or static casting processes and not only a continuous process as described in the foregoing embodiment.

What is claimed is:

1. A method of casting metal or the like comprising melting metal in a primary chamber, controllably feeding the molten metal from said primary chamber to two or more secondary chambers by passing said molten metal sequentially through first and second passage means, said first passage means connecting said primary chamber with a first secondary chamber and said second passage means connecting said first secondary chamber and a second secondary chamber, said second passage means being disposed above said first passage means, and supplying additive material to the melt in one of said secondary chambers.

2. A method as claimed in claim 1, in which the additive material is added close to the solidification point of the metal being cast.

3. A method as claimed in claim 1 or 2, in which the metal is grey iron and magnesium is added thereto in a first secondary chamber and an innoculant or conditioner is added in a second secondary chamber.

* * * * *